US006816761B2

(12) United States Patent
Denton

(10) Patent No.: US 6,816,761 B2
(45) Date of Patent: Nov. 9, 2004

(54) SYSTEM AND METHOD FOR MONITORING MOVING EQUIPMENT OPERATIONS

(76) Inventor: Jack A. Denton, 386 Highway 6 West, Tupelo, MS (US) 38801

( * ) Notice: Subject to any disclaimer, the term of this patent is extended or adjusted under 35 U.S.C. 154(b) by 0 days.

(21) Appl. No.: 10/040,339

(22) Filed: Nov. 1, 2001

(65) Prior Publication Data

US 2003/0083796 A1 May 1, 2003

(51) Int. Cl.[7] ..... G01C 21/00; G06F 7/00
(52) U.S. Cl. ..... 701/35; 701/211; 340/995.1
(58) Field of Search ..... 701/35, 50, 211, 701/213; 342/357.07; 340/990, 995, 995.1, 995.17, 995.18, 995.27; 369/21; 172/4.5

(56) References Cited

U.S. PATENT DOCUMENTS 4,831,539 A * 5/1989 Hagenbuch ..... 701/207
5,646,844 A 7/1997 Gudat et al.
5,659,470 A * 8/1997 Goska et al. ..... 701/35
5,850,341 A * 12/1998 Fournier et al. ..... 701/50
5,897,602 A * 4/1999 Mizuta ..... 701/201
5,924,493 A 7/1999 Hartman et al.
5,944,764 A 8/1999 Henderson et al.
5,955,706 A 9/1999 Fonkalsrud et al.
5,964,298 A 10/1999 Greenspun
5,996,702 A 12/1999 Hall
6,084,542 A * 7/2000 Wright et al. ..... 342/357.13
6,114,993 A * 9/2000 Henderson et al. .... 342/357.17

* cited by examiner

*Primary Examiner*—Michael J. Zanelli

(57) ABSTRACT

A system and method for monitoring moving equipment operations for determining operator efficiencies for moving operations. The system and method for monitoring moving equipment operations includes a position locating assembly coupled to an moving equipment for determining a current position of the moving equipment on an interval basis, a data storage means operationally coupled to the position locating assembly for recording the current position for each interval, and a data processing means for processing and presenting the position information for a user.

37 Claims, 7 Drawing Sheets

SYSTEM AND METHOD FOR MONITORING MOVING EQUIPMENT OPERATIONS

BACKGROUND OF THE INVENTION

1. Field of the Invention

The present invention relates to systems for monitoring moving equipment work cycles and more particularly pertains to a new system and method for monitoring moving equipment operations for determining operator efficiencies for moving operations.

2. Description of the Prior Art

The use of systems for monitoring moving equipment work cycles is known in the prior art. The area is replete with systems which are operationally coupled to actuators controlling the movements of buckets or blades of moving equipment. These systems are optimized for monitoring the efficiency of the equipment itself.

Known prior art includes U.S. Pat. Nos. 5,924,493; 5,944,764; 5,955,706; 5,996,702; 5,964,298; and 5,646,844.

While these devices fulfill their respective, particular objectives and requirements, the aforementioned patents do not disclose a new system and method for monitoring moving equipment operations. The inventive device includes a position locating assembly coupled to an moving equipment for determining a current position of the moving equipment on an interval basis, a data storage means operationally coupled to the position locating assembly for recording the current position for each interval, and a data processing means for processing and presenting the position information for a user.

In these respects, the system and method for monitoring moving equipment operations according to the present invention substantially departs from the conventional concepts and designs of the prior art, and in so doing provides an apparatus primarily developed for the purpose of determining operator efficiencies for moving operations.

SUMMARY OF THE INVENTION

A major component of any moving project is the efficiency of the individual operators themselves. Preplanned operational, contour or cut maps help direct the operators towards executing the operations in an efficient manner. However, ineffective contouring swaths, inefficient transitions between contouring swaths, and idling increase the overall cost of a contouring project through increased fuel consumption, higher labor expenses due to increased hours, and lost opportunities for other projects. Monitoring of operator actions and post analysis can help develop measurements of individual operator efficiency and provide opportunities for cost reductions.

The general purpose of the present invention, which will be described subsequently in greater detail, is to provide a new system and method for monitoring moving equipment operations apparatus and method which has many of the advantages of the systems for monitoring moving equipment work cycles mentioned heretofore and many novel features that result in a new system and method for monitoring moving equipment operations which is not anticipated, rendered obvious, suggested, or even implied by any of the prior art systems for monitoring moving equipment work cycles, either alone or in any combination thereof.

To attain this, the present invention generally comprises a position locating assembly coupled to an moving equipment for determining a current position of the moving equipment on an interval basis, a data storage means operationally coupled to the position locating assembly for recording the current position for each interval, and a data processing means for processing and presenting the position information for a user.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new system and method for monitoring moving equipment operations apparatus and method which has many of the advantages of the systems for monitoring moving equipment work cycles mentioned heretofore and many novel features that result in a new system and method for monitoring moving equipment operations which is not anticipated, rendered obvious, suggested, or even implied by any of the prior art systems for monitoring moving equipment work cycles, either alone or in any combination thereof.

It is another object of the present invention to provide a cost effective means of monitoring operator efficiency which can either be permanently installed onto moving equipment or temporarily coupled to the same for periodic monitoring and assistance as needed.

Still another object of the present invention is to provide a new system and method for monitoring moving equipment operations for determining operator efficiencies for moving operations.

Yet another object of the present invention is to provide a new system and method for monitoring moving equipment operations which includes a position locating assembly coupled to an moving equipment for determining a current position of the moving equipment on an interval basis, a data storage means operationally coupled to the position locating assembly for recording the current position for each interval, and a data processing means for processing and presenting the position information for a user.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
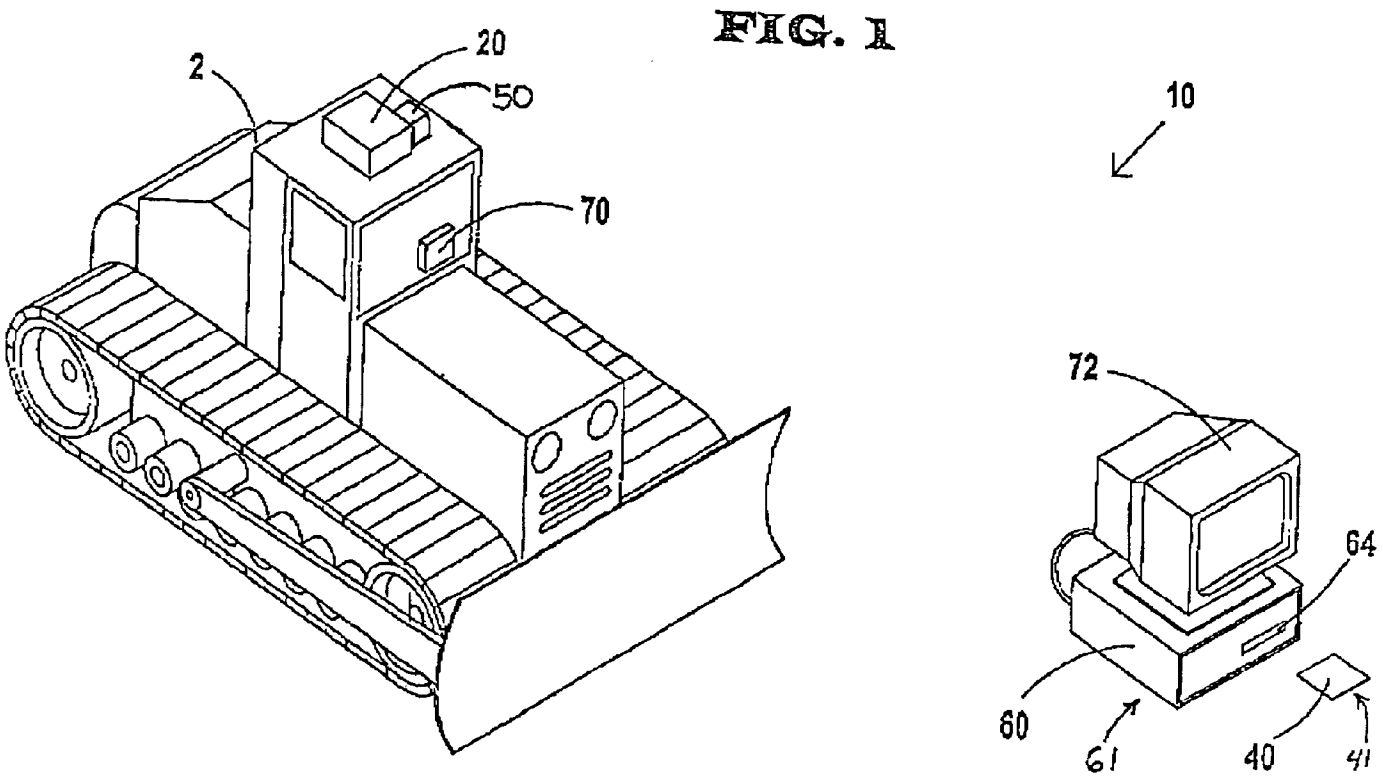
FIG. 1 is a schematic perspective view of a new system and method for monitoring moving equipment operations according to the present invention.
Figure 2:
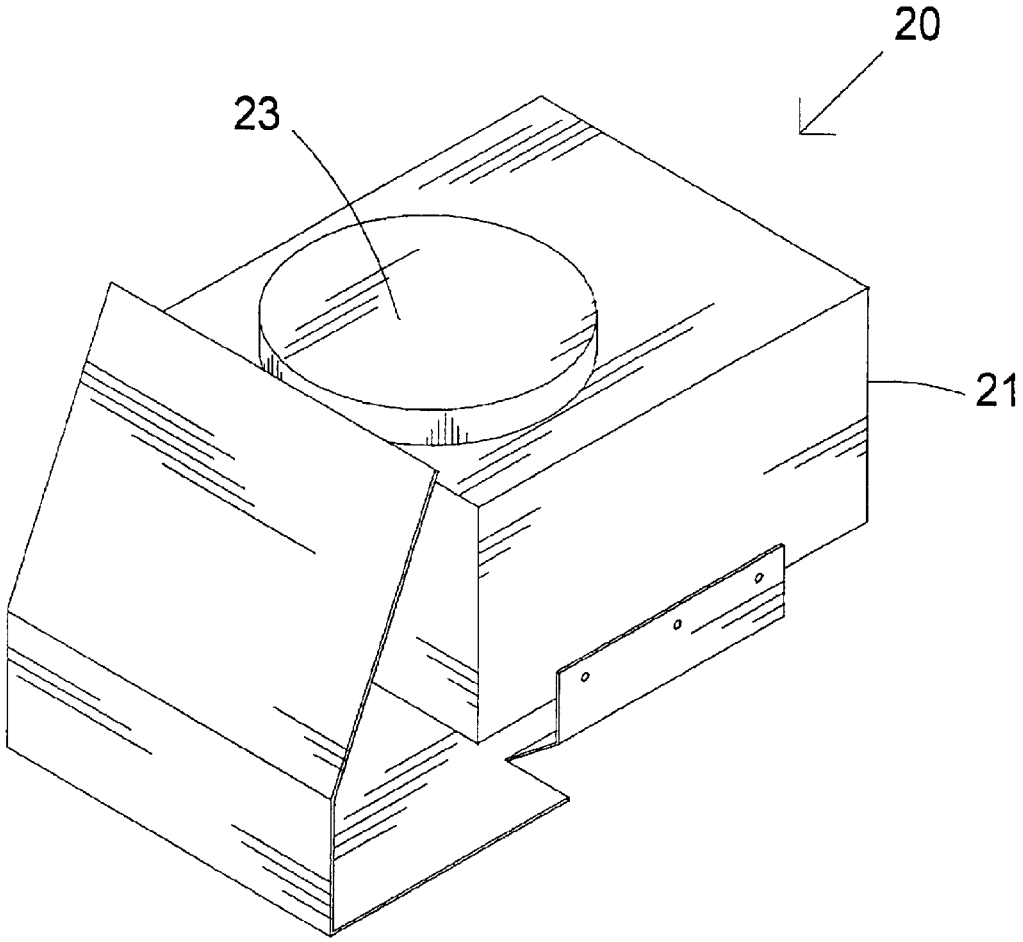
FIG. 2 is a schematic perspective view of the position locating assembly of the present invention.
Figure 3:
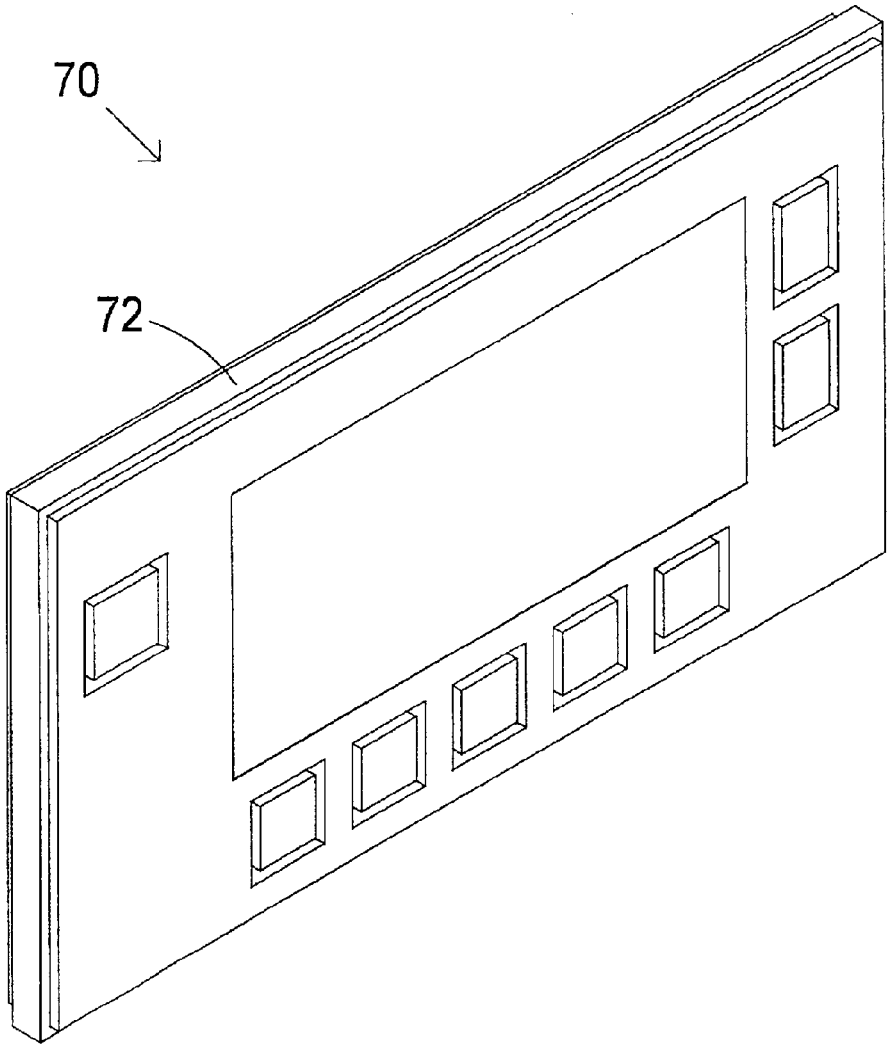
FIG. 3 is a schematic perspective view of an embodiment of the visual display unit of the present invention.
Figure 4:
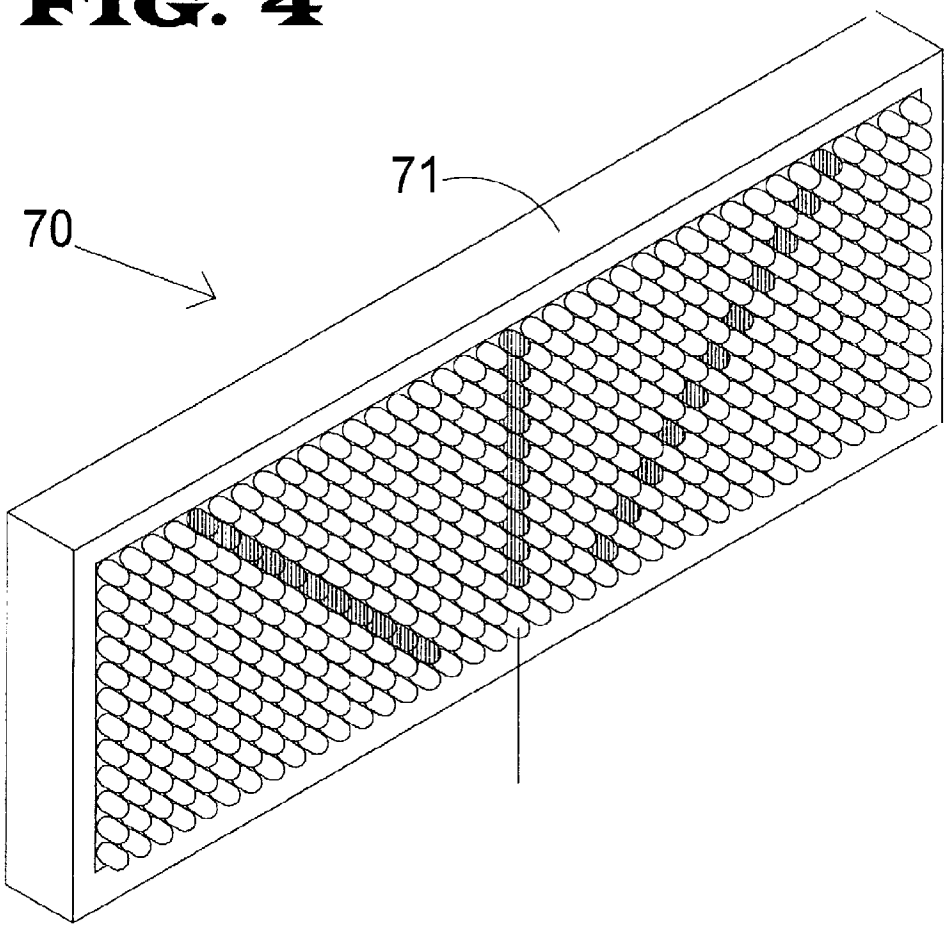
FIG. 4 is a schematic perspective view of an embodiment of the visual display unit of the present invention.
Figure 5:
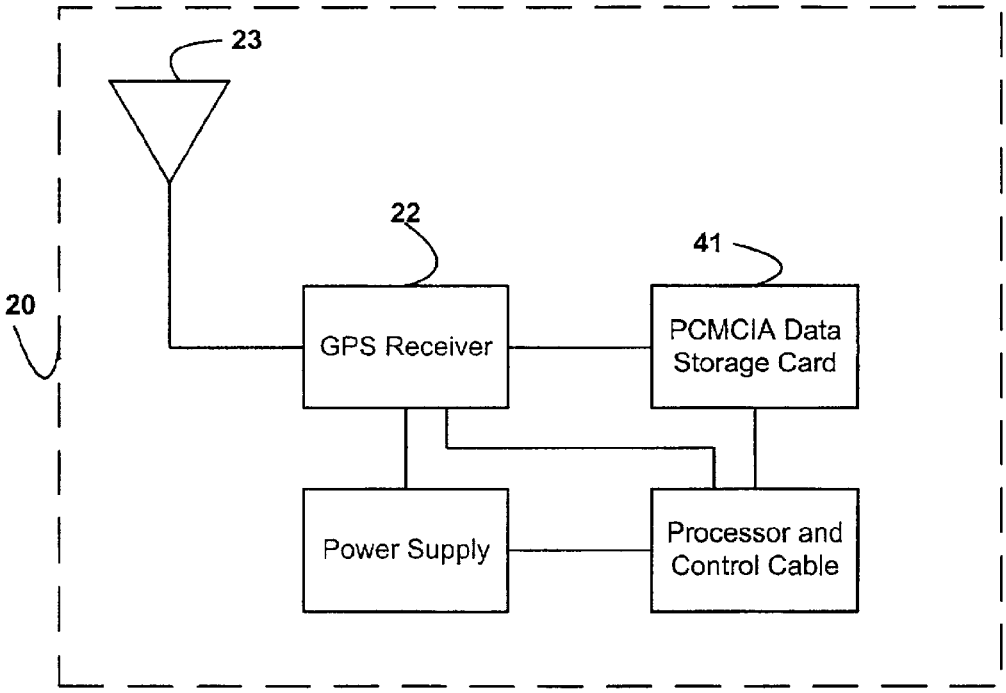
FIG. 5 is a schematic functional interconnect diagram of the position locating assembly of the present invention.
Figure 6:
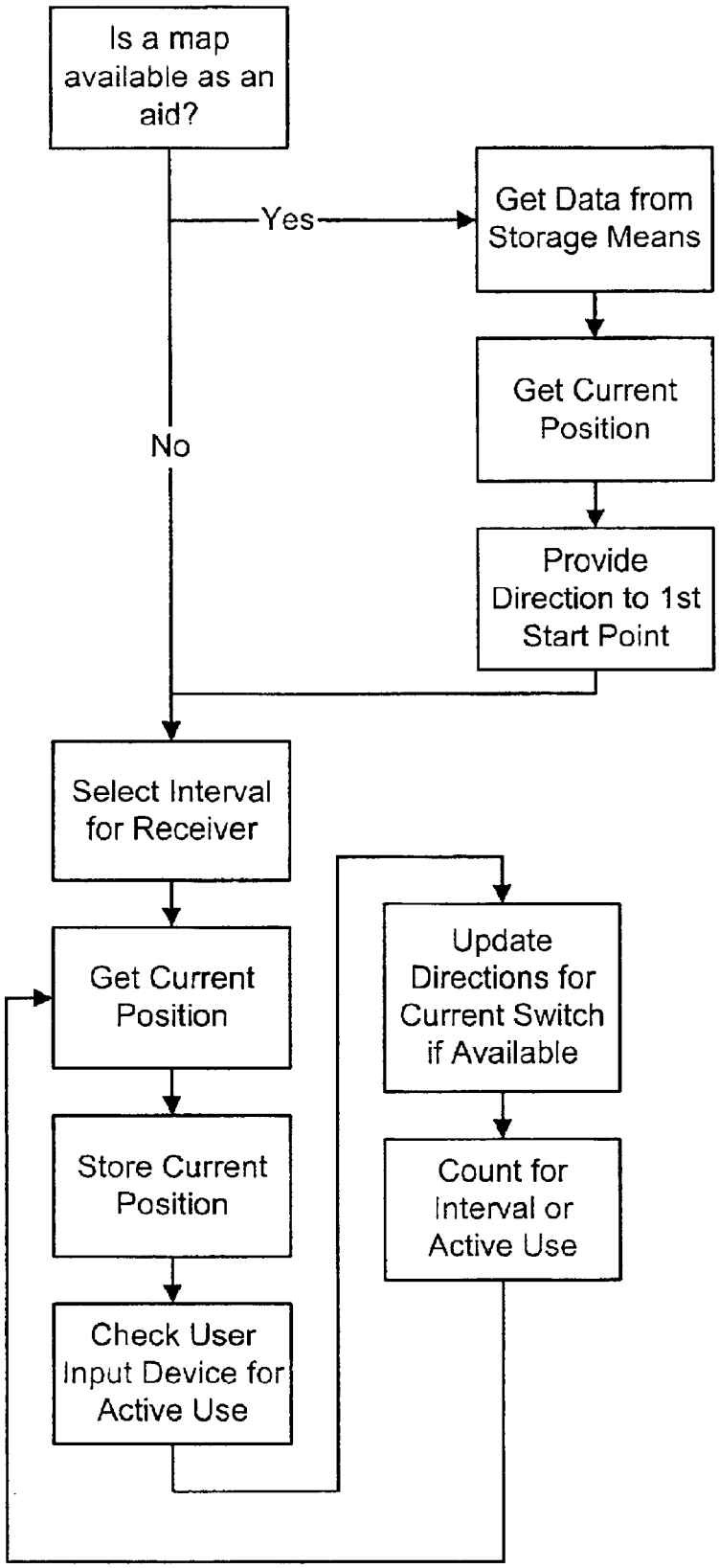
FIG. 6 is a process flow diagram of the position locating assembly the present invention.
Figure 7:
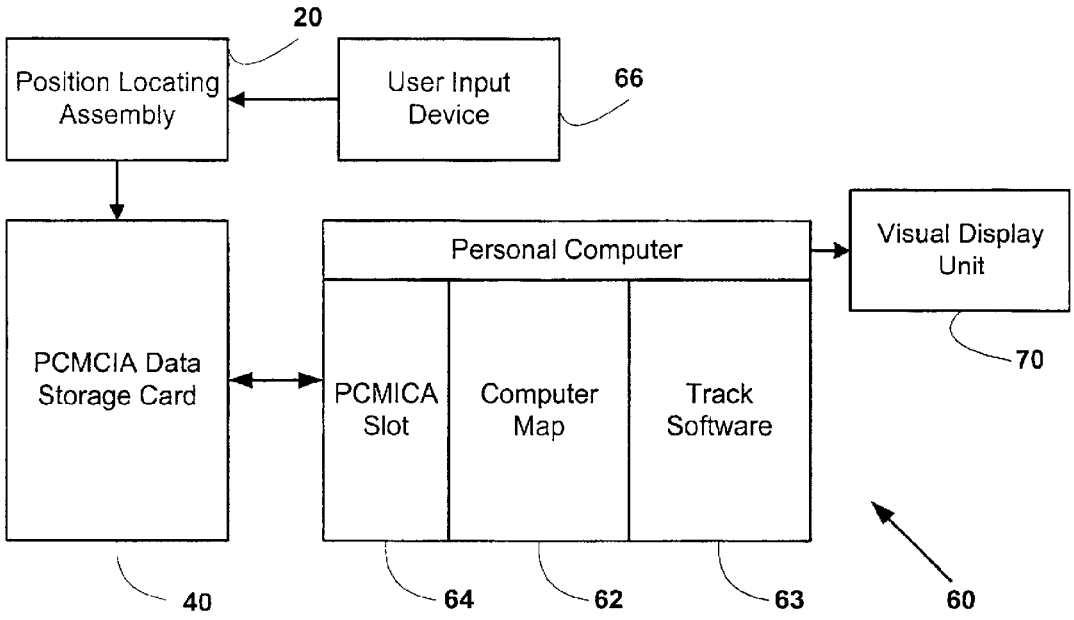
FIG. 7 is a functional interconnect diagram of the present invention.

With reference now to the drawings, and in particular to FIGS. 1 through 7 thereof, a new system and method for monitoring moving equipment operations embodying the principles and concepts of the present invention and generally designated by the reference numeral 10 will be described.

As best illustrated in FIGS. 1 through 7, the system and method for monitoring moving equipment operations 10 generally comprises a position locating assembly 20, a data storage means 40, a data processing means 60, a user input device 66, an operational map 62 and a visual display means 70.

The position locating assembly 20 is coupled to a moving equipment 2. Illustrative examples of moving equipments include, but are not limited to a payloader, a road grader, a bull dozer, crane, and road painter The position locating assembly 20 determines a current position of the moving equipment 2 on an interval basis.

The data storage means 40 is operationally coupled to the position locating assembly 20 for recording the current position for each interval.

The data processing means 60 is used for processing and presenting the position information to a user for analysis.

The user input device 66 is used for providing an indication that the moving equipment 2 is actively operating. The input device 66 is operationally coupled to the data storage means 40 for recording a start and a stop position for each active use of the moving equipment 2.

The operational map 62 is a representation of the area to be operated upon by the moving equipment 2. The operational map 62 is operationally linked to the position locating assembly 20.

The visual display unit assembly 70 provides a navigation aid to the operator of the moving equipment 2 for facilitating accurate operations on the area in accordance with a predetermined plan.

In a preferred embodiment, the position locating assembly 20 further comprises a housing 21, at least one global positioning system (GPS) receiver 22, and at least one antenna 23. The housing 21 may be coupled to the moving equipment 2. The housing 21 includes an interior space. The GPS receiver 22 is positioned substantially within the housing 21 such that the housing 21 provides protection from an external environment. The antenna 23 is operationally coupled to the GPS receiver 22. The antenna 23 facilitates reception of GPS signals by the GPS receiver 22.

In an embodiment, the data storage means 40 comprises a compact flash card 41 for providing a transportable non-volatile storage of the position information for each interval.

In a further embodiment, the compact flash card 41 is operationally coupled to the visual display unit 70 for providing a reference grid for navigating through operating by the moving equipment 2 such that a current position as determined by the position locating assembly 20 is compared to the reference grid facilitates a course correction presented by the visual display unit 70.

Preferably the data processing means 60 further comprises a personal computer 61, an operations map 62, and track software 63. The personal computer 61 is used for processing the information. The operations map 62 may be in a machine readable format for facilitating analysis of paths traveled by the moving equipment 2. The track software 63 is used for developing an overlay of stored present location information for each interval against the operations map.

While a personal computer 61 is preferred, a laptop computer, handheld computer, personal data assistant (PDA), or other similar device can also be used as the data processing means 60.

In an embodiment, the personal computer 61 further comprises a compact flash card reader 64 for selectively connecting with a compact flash card 41 for facilitating transporting current position information for each interval from the position locating assembly 20 to the personal computer 61 for facilitating analysis.

In yet a further embodiment, the track software 63 develops a graphic representation of each swath traveled by the moving equipment 2.

In still a further embodiment, the graphic representation provides an indication for active use of the moving equipment 2 contrasting from swaths where the moving equipment 2 was not actively used. The active use is determined by a start and stop indication from the user input device 66.

In yet a further embodiment the graphic representation provides an indication of the moving equipment 2 remaining in a static position for a duration of more than a predetermined number of intervals.

The interval includes a duration of between 1 and 3600 seconds inclusive. The interval is determinable prior to operation.

In an embodiment, the visual display unit 70 includes a plurality of light emitting diodes positioned in an array 71 for providing a visual indication of the path to be traveled compared with the swath is taken. Thus, the operator of the moving equipment 2 has a navigation aid on a swath by swath basis.

In a further embodiment, the visual display unit 70 is a liquid crystal display 72 for providing a visual indication of the path to be traveled compared with the swath is taken. Thus, the operator of the moving equipment 2 has a navigation aid on a swath by swath basis.

In an embodiment the data storage means 40 is operationally couplable to the data processing means 60 via a coupling means 50 such that stored information may be transferred to the data processing means 60 from the data storage means 40.

In a further embodiment, the coupling means 50 is a cellular modem system for facilitating periodic updates during a work cycle of the moving equipment 2 for analysis.

Preferably, the data storage means 40 also is for recording supplemental data on an interval basis. Illustratively, the supplemental data may further comprise, but need not be limited to the volume of material being moved, changes in volume of material, weight of material being moved, material loaded, and material unloaded. The supplemental data is used to augment analysis of the potion and time data for determining efficiency of work cycles.

In use, an operational, contour or cut map is provided for the area to be worked. A series of operation steps for working the area is developed. Preferably, each of these operational steps are developed with start and stop points for facilitating providing a graphic navigational aid for the operator of the moving equipment.

The position locating assembly is coupled to the moving equipment. If a navigation aid is to be provided to the operator, a visual display unit is also coupled to the moving equipment where visible by the operator. The user input device is also coupled to the moving equipment in a convenient location for use by the operator.

The interval between measurements is selected from a range of 1 second and 3600 seconds (60 minutes). At the start of each interval or when the user input device is activated the GPS receiver determines the current position of the moving equipment as well as the current time. This position and time data is stored on the compact flash card for later analysis.

After completion of the day's operations, the compact flash card is removed from the position locating assembly and is coupled to a processing means. Typically the processing means will either be a personal computer or a laptop. However, other computing means may be used such as PDA, programmable calculators, or scheduling tools.

The recorded position and time information for each interval or active use start and stop indications is then overlayed by a track software with geographic information provided by a geographic information software operationally available to the processing means.

This overlayed information is then presented to the user for analysis. Preferably the presentation is performed by graphically displaying the information on a video monitoring using multiple colors, symbols, or both to highlight areas where unauthorized stops, or detours may have occurred. Additionally, a graphic replay of the moving equipments movements throughout the entire day is possible.

A conventional volume determining means or weight determining means may be operationally coupled to the data storage means for determining a volume of material being moved by the moving equipment. A wide variety of volume determining means are known in the art including ultrasonic sound wave generators and receivers.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A system for monitoring work cycles of moving equipment comprising:

a position locating assembly coupled to a moving equipment, said position locating assembly determining a current position of the moving equipment on an interval basis;

a data storage means operationally coupled to said position locating assembly for recording said current position for each interval;

said data storage means further comprises a compact flash data storage card for providing transportable nonvolatile storage of said position information for each interval;

said compact flash card being operationally coupled to a visual display unit for providing a reference grid for navigating through operating by the moving equipment such that a current position as determined by said position locating assembly being compared to said reference grid facilitates a course correction presented by said visual display unit; and a data processing means for processing and presenting said position information for a user.

2. The system of claim 1, further comprising a user input device for providing an indication that the moving equipment is actively operating, said input device being operationally coupled to said data storage means for recording a start and a stop position for each active use of the moving equipment.

3. The system of claim 1, further comprising a operational map of the area to be operated upon by the moving equipment, said operational map being operationally linked to said position locating assembly.

4. The system of claim 3, further comprising a visual display unit assembly for providing a navigation aid to the operator of the moving equipment for facilitating accurate operations on the area in accordance with a predetermined plan.

5. The system for monitoring work cycles of moving equipment of claim 1, further comprising:

a user input device for providing an indication that the moving equipment is actively operating, said input device being operationally coupled to said data storage means for recording a start and a stop position for each active use of the moving equipment;

a operations map of the area to be operated upon by the moving equipment, said operating map being operationally linked to said position locating assembly; and said visual display unit assembly providing a navigation aid to the operator of the moving equipment for facilitating accurate operations upon the area in accordance with a predetermined plan, said visual display unit assembly being operationally coupled to said position locating assembly.

6. The system of claim 5, wherein said position locating means further comprises a position locating system selected from the group of position locating systems consisting of global positioning system (GPS), long range navigation (LORAN), and inertial navigation system (INS).

7. The system of claim 5, wherein said position locating assembly further comprises:

a housing couplable to the moving equipment, said housing having an interior space;

at least one global positioning system (GPS) receiver, said GPS receiver being positioned substantially within said housing such that said housing providing protection from an external environment;

at least one antenna operationally coupled to said GPS receiver, said antenna facilitating reception of OPS signals by said GPS receiver.

8. The system of claim 5, wherein said data storage means comprises data transfer device selected from the group of data transfer devices consisting of a personal computer memory card international association (PCMCIA) data storage card, a compact flash card, a smart media card, for providing a transportable nonvolatile storage of said position information for each interval.

9. The system of claim 5, wherein said data processing means further comprises:

a personal computer for processing information;

a operations map in a machine readable format for facilitating analysis of paths traveled by the moving equipment;

a track software for developing an overlay of stored present location information for each interval against said operations map.

10. The system of claim 9, wherein said personal computer further comprises a data transfer receiving slot selected from the group of data transfer receiving slots consisting of personal computer memory card international association (PCMCIA) data storage card slot, compact flash card reader, and smart media card reader, for selectively connecting with a data transfer device for facilitating transporting current position information for each interval from said position locating assembly to said personal computer for facilitating analysis.

11. The system of claim 9, wherein said personal computer further comprises a compact flash card reader for selectively connecting with a data transfer device for facilitating transporting current position information for each interval from said position locating assembly to said personal computer for facilitating analysis.

12. The system of claim 9, wherein said laptop computer further comprises a compact flash card reader for selectively connecting with a data transfer device for facilitating transporting current position information for each interval from said position locating assembly to said personal computer for facilitating analysis.

13. The system of claim 5, wherein said data processing means further comprises:

a laptop computer for processing information;

a operations map in a machine readable format for facilitating analysis of paths traveled by the moving equipment;

a track software for developing an overlay of stored present location information for each interval against said operations map.

14. The system of claim 13, wherein said laptop computer further comprises a data transfer receiving slot selected from the group of data transfer receiving slots consisting of personal computer memory card international association (PCMCIA) data storage card slot, compact flash card reader, and smart media card reader, for selectively connecting with a data transfer device for facilitating transporting current position information for each interval from said position locating assembly to said personal computer for facilitating analysis.

15. The system of claim 5, further comprising:

said position locating assembly further comprises:

a housing couplable to the moving equipment, said housing having an interior space;

at least one global positioning system (GPS) receiver, said GPS receiver being positioned substantially within said housing such that said housing providing protection from an external environment;

at least one antenna operationally coupled to said GPS receiver, said antenna facilitating reception of GPS signals by said GPS receiver;

said data processing means further comprises:

a personal computer for processing information;

a operations map in a machine readable format for facilitating analysis of paths traveled by the moving equipment;

a track software for developing an overlay of stored present location information for each interval against said operations map; and said personal computer further comprises a compact flash card reader for selectively connecting with a compact flash card for facilitating transporting current position information for each interval from said position locating assembly to said personal computer for facilitating analysis.

16. The system of claim 15, wherein said track software developing a graphic representation of each swath traveled by the moving equipment.

17. The system of claim 16 wherein said graphic representation provides an indication for active use of the moving equipment contrasting from swaths where the moving equipment was not actively used, said active use being determined by a start and stop indication from said user input device.

18. The system of claim 16, wherein said graphic representation providing an indication of the moving equipment remaining in a static position for a duration of more than a predetermined number of intervals.

19. The system of claim 15, wherein said interval having a duration of between 1 and 3600 seconds inclusive, said interval being determinable prior to operation.

20. The system of claim 15, wherein said visual display unit having a plurality of light emitting diodes positioned in an array for providing a visual indication of the path to be traveled compared with the swath being taken whereby the operator of the moving equipment has a navigation aid on a swath by swath basis.

21. The system of claim 15, wherein said visual display unit being a liquid crystal display for providing a visual indication of the path to be traveled compared with the swath being taken whereby the operator of the moving equipment has a navigation aid on a swath by swath basis.

22. The system of claim 21, wherein said visual display unit, said data processing means and said data storage means each being positioned within a single display housing, said processing means being operationally coupled to said data storage means, said visual display unit and said user input device for providing a simplified user system.

23. The system of claim 15, wherein said data storage means being operationally couplable to Raid data processing means via a coupling means such that stored information may be transferred to said data processing means from said data storage means.

24. The system of claim 23, wherein said coupling means being a coupling means selected from the group consisting of an electrical signal connection, an optical signal connection, a radio link, an infrared link, and a cellular modem system.

25. The system of claim 23, wherein said coupling means being a cellular modem system for facilitating periodic updates during a work cycle of the moving equipment for analysis.

26. The system of claim 15, wherein said data storage means being for recording current position, time and supplemental data on an interval basis.

27. A method of monitoring moving equipment comprising:

providing a position locating assembly couplable to a piece of moving equipment, said position location assembly determining a current position of the moving equipment on an interval basis;

providing a compact flash card operationally coupled to said position locating assembly for recording current position data for each interval, said compact flash card facilitating transportation of said position data in a nonvolatile format, said compact flash card being operationally coupled to a visual display unit for providing a navigation aid for an operator of the moving equipment comparing a current position during a swath with a predetermined path represented on a operations map;

obtaining a operations map for the area to be operated upon by the moving equipment;

providing a data processing means for processing the position data for each interval into a graphic representation for facilitating analysis by a user.

28. The method of claim 27, wherein said step of providing a position locating assembly further comprises providing a position locating system selected from the group of position locating systems consisting of global positioning system (GPS), long range navigation (LORAN), and inertial navigation system (INS).

29. The method of claim 27, wherein said step of providing a position locating assembly further comprises:

providing at least one global positioning system (GPS) receiver, said GPS receiver being couplable to the moving equipment;

providing at least one antenna operationally coupled to said GPS receiver for facilitating reception of GPS signals by said GPS receiver;

determining a duration of an interval period between position determinations by said GPS receiver.

30. The method of claim 29, wherein said step of determining a duration of an interval period further comprises selecting an duration having a length of between 1 and 3600 seconds inclusive.

31. The method of claim 27, wherein said step of providing a compact flash card further comprises providing a data transfer device selected from the group of data transfer devices consisting of compact flash card, smart media card, and personal computer memory card international association (PCMCIA) data storage card, said data transfer device facilitating transportation of said position data in a nonvolatile format.

32. The method of claim 27, further comprising:

providing a user input device for generating a start and stop reference point for each swath indicating an active use of the moving equipment;

activating said user input device at the start of a swath;

recording a current position corresponding to the start of the swath;

completing the swath with the moving equipment;

activating said user input device at the end of the swath;

recording a current position corresponding to the end of the swath.

33. The method of claim 27, further comprising:

transferring the position data from said data storage means to said data processing means;

overlaying said position data onto said operations map;

processing said data into a graphical representation;

generating an output display highlighting anomalous events for facilitating analysis of said data by the user.

34. The method of claim 33, wherein said anomalous events include any anomalous event selected from the list of anomalous events comprising multiple identical position data for consecutive intervals, swaths not actively using the moving equipment, and inefficient crossing through paths on said operations map.

35. The method of claim 27, further comprising providing a coupling means for operationally coupling to said data processing means to said data storage means such that stored information may be transferred to said data processing means from said data storage means.

36. The system of claim 35, wherein said coupling means being a coupling means selected from the group consisting of an electrical signal connection, an optical signal connection, a radio link, an infrared link, and a cellular modem system.

37. The system of claim 35, wherein said coupling means being a cellular modem system for facilitating periodic updates during a work cycle of the moving equipment for analysis.

* * * * *